US012515856B2

(12) United States Patent
Fleming

(10) Patent No.: US 12,515,856 B2
(45) Date of Patent: Jan. 6, 2026

(54) RECLOSABLE DISPOSABLE LID

(71) Applicant: VIORALID, LLC, Bainbridge Island, WA (US)

(72) Inventor: Douglas H. Fleming, Bainbridge Island, WA (US)

(73) Assignee: VIORALID, LLC, Quilcene, WA (US)

( * ) Notice: Subject to any disclaimer, the term of this patent is extended or adjusted under 35 U.S.C. 154(b) by 524 days.

(21) Appl. No.: 18/302,345

(22) Filed: Apr. 18, 2023

(65) Prior Publication Data

US 2023/0257170 A1 Aug. 17, 2023

Related U.S. Application Data

(63) Continuation of application No. PCT/US2021/055471, filed on Oct. 18, 2021.
(Continued)

(51) Int. Cl.
*B65D 51/18* (2006.01)
*B65D 43/02* (2006.01)

(52) U.S. Cl.
CPC ..... *B65D 51/18* (2013.01); *B65D 43/0212* (2013.01); *B65D 2543/00046* (2013.01);
(Continued)

(58) Field of Classification Search
CPC ..... B65D 43/0212; B65D 43/0218; B65D 47/02018; B65D 47/2025; B65D 47/36;
(Continued)

(56) References Cited

U.S. PATENT DOCUMENTS 2,358,600 A 9/1944 Selten
2,362,354 A 11/1944 Clovis
(Continued)

FOREIGN PATENT DOCUMENTS

CA 2245369 3/2000
CA 2212228 7/2002
(Continued)

OTHER PUBLICATIONS

Louise Harpman & Scott Specht, Cabinet Magazine, Inventory/Peel, Pucker, Pinch, Puncture. Issue 19, Chance Fall 2005 (Sep. 2005). http:/www.cabinetmagazine.org/issues/19/harpman.php (4 pages).
(Continued)

*Primary Examiner* — Andrew T Kirsch
(74) *Attorney, Agent, or Firm* — R. Reams Goodloe, Jr.

(57) ABSTRACT

A drink-through type lid for a cup. The lid is configured for sealing a cup containing liquid such as coffee, and includes a rim, a cover, and a flexible closure structure. The flexible closure structure includes multiple panels which are hinged from stationary portions of the lid. In an embodiment a stiff frame structure is provided. The hinges are on a common inclined plane P sloping downward toward a drink outlet. A lever is used to manipulate the flexible structure between a drink outlet open position and a drink outlet closed position. The lever folds downward to avoid interference with a user's nose, and the cover includes a sump portion which also provides additional clearance for a user's nose. The flexible structure may be provided with snap action which enables multiple openings and closings of the drink opening.

44 Claims, 9 Drawing Sheets

Related U.S. Application Data

(60) Provisional application No. 63/093,458, filed on Oct. 19, 2020.

(52) U.S. Cl.
CPC ..... *B65D 2543/00092* (2013.01); *B65D 2543/00296* (2013.01); *B65D 2543/00351* (2013.01); *B65D 2543/00731* (2013.01); *B65D 2543/00796* (2013.01)

(58) Field of Classification Search
CPC ..... B65D 2543/00046; B65D 2543/00222; B65D 2543/0025; B65D 51/18
See application file for complete search history.

(56) References Cited

U.S. PATENT DOCUMENTS 3,227,304 A 1/1966 Ashury
3,360,161 A 12/1967 Smith
3,400,855 A 9/1968 Alexander
3,860,162 A 1/1975 Schutz
3,868,043 A 2/1975 Freemyer
3,938,695 A 2/1976 Ruff
3,977,559 A 8/1976 Lombardi
3,994,411 A 11/1976 Elfelt et al.
4,081,103 A 3/1978 Zoellick
4,085,861 A 4/1978 Ruff
4,090,660 A 5/1978 Schram et al.
4,113,135 A 9/1978 Yamazaki
4,184,604 A 1/1980 Amberg
4,190,174 A 2/1980 Haimowitz
4,210,256 A 7/1980 Amberg
4,245,752 A 1/1981 Prucher
4,345,695 A 8/1982 Galloway
4,350,260 A 9/1982 Prueher
4,361,249 A 11/1982 Tuneski
4,412,629 A 11/1983 Dart
4,502,608 A 3/1985 Mills
4,503,992 A 3/1985 Sitko
4,582,214 A 4/1986 Dart et al.
4,586,625 A 5/1986 Garrett
4,589,569 A 5/1986 Clements
4,609,124 A 9/1986 Malloy
4,619,372 A 10/1986 McFarland
D287,919 S 1/1987 Clements
4,723,684 A 2/1988 Lambert
4,768,674 A 9/1988 Prescott
D299,010 S 12/1988 Wal
4,938,377 A 7/1990 Jarvis
4,949,865 A 8/1990 Turner
4,986,437 A 1/1991 Farmer
5,111,961 A 5/1992 Van Melle
5,183,172 A 2/1993 Boller
D342,097 S 12/1993 Seaman
D345,673 S 4/1994 Dark
5,370,258 A 12/1994 Fair
5,398,843 A * 3/1995 Warden ..... B65D 47/2018 220/254.1
5,540,350 A 7/1996 Lansky
5,542,670 A 8/1996 Morano
D377,313 S 1/1997 Tipp
D377,810 S 2/1997 Chaperon
5,699,927 A 12/1997 Lane et al.
5,820,016 A 10/1998 Stropkay
5,894,952 A 4/1999 Mendenhall et al.
5,897,019 A 4/1999 Stropkay
D416,755 S 11/1999 Trombly
5,988,426 A 11/1999 Stern
6,003,711 A 12/1999 Bilewitz
6,079,586 A 6/2000 Hanneman
6,176,420 B1 1/2001 Sarson
6,196,411 B1 3/2001 Nava et al.
6,311,863 B1 11/2001 Fleming
6,325,236 B1 12/2001 Wong
6,375,033 B1 4/2002 Fleming
D456,713 S 5/2002 Bried et al.
D458,844 S 6/2002 Shea
6,419,105 B1 7/2002 Bruce et al.
6,419,112 B1 7/2002 Bruce et al.
6,431,390 B1 8/2002 Waller
6,488,170 B1 12/2002 Johnson
6,488,173 B2 12/2002 Milan
6,571,973 B1 6/2003 Tripsianes
6,612,456 B1 9/2003 Hundley
D480,754 S 10/2003 Berger
6,644,490 B2 11/2003 Clarke
D485,758 S 1/2004 Clarke et al.
6,752,287 B1 6/2004 Lin
6,886,707 B2 5/2005 Giraud
6,889,859 B1 5/2005 Leon
6,905,044 B1 6/2005 Russo et al.
D510,266 S 10/2005 Walsh et al.
7,100,790 B2 9/2006 Dark
7,185,781 B2 3/2007 Pitts
D539,649 S 4/2007 Smith et al.
D539,650 S 4/2007 Smith et al.
D540,165 S 4/2007 Hollis et al.
D546,180 S 7/2007 Jowett et al.
D547,605 S 7/2007 Edelstein et al.
7,246,716 B2 7/2007 Durdon
7,275,652 B2 10/2007 Morris et al.
D566,552 S 4/2008 Vette
7,353,582 B2 4/2008 Mackenzie et al.
7,484,638 B2 2/2009 Mazzarolo
D592,056 S 5/2009 Tedford, Jr.
D592,952 S 5/2009 Hundley et al.
7,556,172 B2 7/2009 Lane
7,591,393 B2 9/2009 Crudgington, Jr.
D622,995 S 9/2010 Beraha
D627,827 S 11/2010 Rogers
D632,174 S 2/2011 Charbonnet et al.
D634,192 S 3/2011 Mueller
D635,855 S 4/2011 Smith
D637,079 S 5/2011 Brown et al.
7,959,029 B2 6/2011 Whitaker et al.
D641,242 S 7/2011 Pfarrhofer
D643,245 S 8/2011 Minarsch
D652,300 S 1/2012 Anderson et al.
D655,161 S 3/2012 Daniel
D655,162 S 3/2012 Daniel
D656,023 S 3/2012 Baker et al.
D660,718 S 5/2012 McDermott et al.
D675,524 S 2/2013 Bickert et al.
D679,753 S 4/2013 Sato et al.
D681,453 S 5/2013 Glass et al.
D690,988 S 10/2013 Audette
D691,847 S 10/2013 Beckman
D692,756 S 11/2013 McClellan et al.
8,602,252 B2 12/2013 Syrkos
8,616,405 B2 12/2013 French et al.
D704,054 S 5/2014 Fleming
D704,055 S 5/2014 Fleming
8,733,583 B2 5/2014 Bailey
D708,515 S 7/2014 Fleming
D709,366 S 7/2014 Fleming
D709,367 S 7/2014 Fleming
D711,226 S 8/2014 Fleming
D713,685 S 9/2014 Eyal
D721,271 S 1/2015 Fabiszewski
D721,540 S 1/2015 Grcic
D722,498 S 2/2015 Fleming
8,950,623 B2 2/2015 Fleming
9,061,796 B2 6/2015 Caldwell
D751,396 S 3/2016 Fleming
9,642,483 B2 5/2017 Fleming
9,751,665 B2 9/2017 Fleming
9,751,666 B2 9/2017 Brannock
D807,746 S 1/2018 Fleming
2002/0038803 A1 4/2002 Malcolm
2002/0096530 A1 7/2002 Waller
2003/0089714 A1 5/2003 Dart et al.
2003/0218017 A1 11/2003 Schmidtner et al.
2005/0087539 A1 4/2005 Waller

(56) References Cited

U.S. PATENT DOCUMENTS

| | | | |
|---|---|---|---|
| 2005/0205588 | A1 | 9/2005 | Pitts |
| 2007/0114236 | A1 | 5/2007 | Shiffer et al. |
| 2007/0164026 | A1 | 7/2007 | Morrissey et al. |
| 2007/0199945 | A1 | 8/2007 | Ho |
| 2008/0011762 | A1 | 1/2008 | Boone |
| 2008/0061069 | A1 | 3/2008 | Edelstein et al. |
| 2008/0245792 | A1 | 10/2008 | Chou |
| 2009/0032543 | A1 | 2/2009 | Lee et al. |
| 2009/0266828 | A1 | 10/2009 | Cai |
| 2009/0266829 | A1 | 10/2009 | Bailey |
| 2009/0294459 | A1 | 12/2009 | Hovsepian et al. |
| 2009/0294460 | A1 | 12/2009 | Hovsepian et al. |
| 2011/0114655 | A1 | 5/2011 | Bailey |
| 2011/0266294 | A1 | 11/2011 | Charbonnet et al. |
| 2012/0024871 | A1 | 2/2012 | Hundley et al. |
| 2012/0152968 | A1 | 6/2012 | Bailey |
| 2014/0057023 | A1 | 2/2014 | Sabga et al. |
| 2015/0223625 | A1 | 8/2015 | Fleming |
| 2017/0303713 | A1 | 10/2017 | Fleming |
| 2018/0127168 | A1 | 5/2018 | Fleming |
| 2019/0023459 | A1 | 1/2019 | Fleming |
| 2020/0029711 | A1 | 1/2020 | Brannock |

FOREIGN PATENT DOCUMENTS

| | | | |
|---|---|---|---|
| CA | 2539528 | A1 | 9/2006 |
| CA | 2635219 | | 7/2008 |
| CN | 1328522 | A | 12/2001 |
| CN | 1585716 | A | 2/2005 |
| CN | 1840433 | A | 10/2006 |
| EP | 1230130 | B1 | 2/2004 |
| EP | 1118549 | B1 | 5/2006 |
| EP | 1043243 | B1 | 9/2006 |
| EP | 2121465 | B1 | 12/2013 |
| EP | 002469494-0001 | | 5/2014 |
| GB | 2307633 | A | 6/1997 |
| GB | 2322289 | A | 6/1998 |
| JP | 09-156661 | A | 6/1997 |
| JP | 2009-154953 | A | 7/2009 |
| KR | 20170066204 | A | 6/2017 |
| WO | WO 96/39068 | | 12/1996 |
| WO | WO 2009/008587 | A1 | 1/2009 |
| WO | WO 2009/036426 | A2 | 3/2009 |
| WO | WO 2010/042027 | A1 | 4/2010 |
| WO | WO 2011/024012 | A1 | 3/2011 |
| WO | WO 2014/014844 | A1 | 1/2014 |
| WO | WO 2015/123150 | A1 | 8/2015 |
| WO | WO 2018/096503 | A1 | 5/2018 |

OTHER PUBLICATIONS

Nicola, Edible Geography, The Evolution of Lids. (May 9, 2011), http://www.ediblegeography.com/the-evolution-of-lids/ (7 pages).

Supplemental European Search Report & Opinion Dated Sep. 30, 2015 European Patent Application No. EP13763858 (dated Oct. 9, 2015) (6 pgs).

Date unknown. Printed Nov. 15, 2013. Product Design (physical goods): Why is the Solo Traveler the dominant coffee cup lid? http://www.quora.com/Product-Design-physical-goods/Why-is-the-Solo-Traveler-the-dominant-coffee-cup-lid (7 pages).

"The Viora Lid Finally Solves the Problem of Terribly Designed Disposable Coffee Cup Lids", WallStreetinsanity.com, pp. 1-4 of 14 pages attached. Published May 15, 2014 online at http://wallstreetinsanity.com/the-viora-lid-finally-solves-the-problem-of-terribly-designed-disposable-coffee-cup-lids/.

PCT International Search Report—PCT/US2015/015069 (May 15, 2015) ISA:—Korean Intellectual Property Office (3 pages).

PCT Written Opinion of the International Searching Authority—PCT/US2015/015069 (May 15, 2015) ISA:—Korean Intellectual Property Office (10 pages).

Notification Concerning Transmittal of International Preliminary Report on Patentability—Dated: Aug. 25, 2016 with International Preliminary Report on Patentability ; Written Opinion of the International Searching Authority—Dated: Aug. 25, 2016 (PCT/US2015/015069) (12 pages).

Search Report—The State Intellectual Property Office of the People's Republic of China. Dated: Oct. 22, 2015 Chinese Patent Application No. 201380016011.2 Chinese Language.

Search Report—The State Intellectual Property Office of the People's Republic of China. Dated: Oct. 22, 2015 Chinese Patent Application No. 201380016011.2 English Translation.

International Preliminary Report on Patentability—Dated: May 4, 2023, Written Opinion of the International Searching Authority (PCT/US2021/055471) (9 pages).

* cited by examiner

RECLOSABLE DISPOSABLE LID

CROSS-REFERENCE TO RELATED PATENT APPLICATIONS

This application is a continuation of PCT/US2021/055471, filed on Oct. 18, 2021, and published as WIPO Publication No. WO 2022/086876 A1 on Apr. 28, 2022, entitled Reclosable Disposable Lid. That PCT application claimed priority under 35 USC. § 119(e) from U.S. Provisional Patent Application Ser. No. 63/093,458 filed on Oct. 19, 2020 entitled Reclosable Disposable Lid. The disclosures of each of PCT/US2021/055471 and U.S. Provisional Application Ser. No. 63/093,458, are incorporated herein in their entirety including the specification, drawing, and claims, by this reference.

STATEMENT OF GOVERNMENT INTEREST

Not applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure relates to lids for drinking cups, and more specifically, to a drink-through lid for beverage containers, and elements thereof useful to minimize or substantially avoid escape of liquids through the lid.

BACKGROUND OF THE INVENTION

Disposable beverage containers—of the type known as cups and which are described herein as drinking cups or beverage cups—are ubiquitous for use in "on-the-go" consumption of liquids, particularly hot beverages such as coffee or tea. Disposable beverage cups often utilize a disposable lid. Various lid designs include openings therein, or openable portions therein, configured with the idea of minimizing splashing or spilling of the beverage from the cup.

One type of disposable lid that is now widely used is a drink-through type lid that provides a horizontally oriented drink outlet on a top surface of a raised rim. Such a design allows a user to drink-through the lid in a manner similar in many respects to drinking through a straw, in that it usually seems that a limited amount of liquid is provided through the opening. Unfortunately, and especially during transport, lids with such openings may allow escape of liquid (especially when full), unless the drink outlet is sealed, such as by use of a stopper or plug. Consequently, spill prevention devices used with such designs do not allow drinking without subsequent removal of the stopper or plug. Similarly, other disposable lids have been provided that include rip-open or fold-back tabs that lift to allow drinking, but which prevent drinking until such tabs are removed or folded.

One concept of using a flexible structure that can be transitioned from a convex shape to a concave shape to open the drink opening of a beverage container lid was described in my prior patent application, published as US Pat. App. Pub. No. 2019/0023459 A1, on Jan. 24, 2019, and titled Drink-Through Reclosable Spill Resistant Beverage Cup Lid with Vent Structure, the disclosure of which is incorporated herein in its entirety, including the specification, claims, and drawing figures. However, even though that design provided many improvements over prior art lids, it must be recognized that the design provided in that disclosure did not overcome all of the various obstacles in enhancing the drinking experience, some of which shortcomings remain inherent in that design. Thus, there is significant room in the art for further improvements.

In general, drink-through lid designs are constrained by the volume limitations of the three dimensional space which is available within the size limitations and workable shapes (e.g. manufacturing constraints, stacking and storage constraints, and functionality issues) for lids. Some of the issues which a designer needs to consider include:

(a) First, in a drink-over rim or drink-through lid design, there must be adequate space from the drink rim inward toward other features of the lid, in order to allow for the top lip of a user to only touch the drink rim when drinking from the lid.

(b) Second, a drink opening must be spaced from and located a sufficiently large distance down the inner side wall of the drink rim so that the user's top lip does not hit the edge of, or cover, the drink opening.

(c) Third, there must be adequate space for the user's nose—i.e. to not rub against the lid, when the flexible structure is in the downward position with the drink outlet open.

(d) Fourth, the flexible structure must operate within a limited vertical space. The overall height of the lid cannot be too tall, and the flexible structure cannot extend too far downward into the container, i.e. into liquids in the cup, when in the downward position with the drink outlet open.

(e) Fifth, the structure and operational method provided and utilized for transitioning the flexible structure from an upward, drink outlet closed position to a downward, drink outlet open position, should avoid requiring a user to push on the structure at a location that is too close to the drink opening location, since it becomes an unpleasant user experience if the user must place their finger too close to the drink well where liquid pools form (when opening) or already exist (while transitioning the flexible structure to an upwardly, drink outlet closed position), after having used the lid in an open position for taking a drink.

(f) Sixth, there must be sufficient surface area on a portion of the flexible structure which is manipulated by the user, in order to allow the user to be able to comfortably and reliably transition the flexible structure from closed to open, and from open to closed.

(g) Seventh, the flexible structure must satisfactorily transition from a drink outlet closed position to a drink outlet open position, and vice versa, while minimizing or eliminating structures such as slits that may have undesirable effects.

The above noted design constraints are, at least to some substantial degree, addressed in my above noted patent application. But, in that structure, an actuator is provided for the flexible structure which is spaced away from the drink opening, and occupies a relatively large portion of the overall surface area of the lid, in order to provide a sufficiently large area for the user to push on to transition the structure from closed to open. Thus, the flexible structure provided in that application is provided in a predominantly horizontal configuration, in order to fit the flexible structure within the dimensions available in the volume provided in the constrained three dimensional space. Unfortunately, the relatively large, substantially horizontally positioned flexible structure provided in that application results in a drink well with a relatively shallow floor, which is not optimal for drainage of liquid therefrom. In addition, given the size of the flexible structure provided, the attachment of a reclosing actuator opposite the drink opening would be problematic, since such an actuator would occupy the area where the user's nose should otherwise be located when drinking a liquid through the lid. Consequently, the design disclosed in that patent application provides a structure which makes it somewhat difficult to reclose the flexible structure by returning the flexible structure to an upward, drink outlet closed position.

Thus, there remains a need for a lid design for a disposable beverage cup or container that simultaneously minimizes or avoids spill of liquid from the beverage cup or container, while allowing the user to drink through the lid. It would be even more advantageous for such a lid design to be provided in a single piece, low cost, disposable material. It would be additionally desirable if such a lid design were available in a configuration that is easy to ship, compact for storage, and easy to install at point of sale. Further, it would be desirable if such a lid enhanced ease of use, by substantially preventing liquid spill during transport, while allowing drinking when opened, yet easily enabling the lid to be reversibly resealed to prevent spillage of liquid through the lid.

SUMMARY OF THE INVENTION

I have now developed a new design for a drink-through lid which provides a flexible structure that easily transitions to or from a drink outlet open position. In an embodiment, the design uses a lever located at an inward edge of the flexible structure. In an embodiment, the design uses a lever which is easily manipulated by a user to move the flexible structure between an upward, drink outlet closed position, and a downward, drink outlet open position. In an embodiment, the flexible structure may be provided in a configuration where the hinges connecting the flexible structure to the stationary portions of the lid are configured to operate along a single, common inclined plane.

The drink-through lids described herein have been designed so that flexible spill resistant structures may be fabricated utilizing conventional manufacturing processes, such as by thermoforming. In various embodiments, drink-through lids with the novel flexible spill resistant structures provided herein significantly enhance a user's beverage drinking experience as compared to various prior art drink-through lids for beverage cups. The novel spill resistant flexible structures are configured to ideally prevent, or at least provide minimization of liquid spills through the lid of a beverage cup when the flexible structure is in the closed position, and also limit splashing when the flexible structure is in the open position. Importantly, the novel flexible structure provided by the lid designs disclosed herein allow a user to drink from the cup or beverage container without the necessity of removing rip-open tabs, or removing closure devices such as plugs or stoppers.

In an embodiment, a drink-through lid is provided for a beverage cup having an open end circumscribed by a sealing bead. The drink-through lid has a rim with a bottom edge, and an interior bead sealing portion having an upper edge. The base is sized and shaped to sealingly engage the open end of the beverage cup. The drink-through lid is provided with a raised lip portion having an exterior portion extending upwardly from the base. An outer lip portion is provided, and an interior portion is provided sloping downwardly from the outer lip portion to lower end portions. A cover is provided extending inwardly from at least some of the raised lip portion. The cover includes a deck extending inwardly from the raised lip portion, and a sump portion located in an interior portion of the deck. The sump portion may be lower, i.e. more toward the cup below, as compared to the position of the deck, and thus provides additional clearance space for the nose of a user.

A flexible structure is provided. The flexible structure may be provided by a plurality of interconnected panels and a lever. In an embodiment, a plurality of polygonal panels may be provided. In an embodiment, the plurality of polygonal panels may include outer members and one or more central members. In an embodiment, the one or more central members may comprise polygonal members. In an embodiment, the one or more central members may be provided in an irregular hexagonal shape. In an embodiment, a plurality of hinges connects the movable flexible structure to a stationary sump portion. In an embodiment, at least some of the plurality of hinges may be located along a plane P which is oriented downward toward the outer lip portion, when compared to a reference plane $H_0$, which is located at an upper edge of the interior bead sealing portion. In an embodiment, all of the hinges in the plurality of hinges connecting the movable flexible structure to the stationary portions of the lid, such as the sump portion, may be located along a common inclined plane P.

Each of the outer members of the flexible structure has an outer edge, and each outer edge may be joined to the stationary sump portion via a hinge. Each of the outer members of the flexible structure has an inner edge, and each inner edge may be joined via a hinge to the one or more central polygonal members. The lever may be joined by at least one hinge to the sump portion, and by hinges to the adjacent outer members of the flexible structure, and by at least one hinge to the one or more central members. The lever, when having moved the flexible structure to a downwardly shaped structure, is positioned below the height of the raised lip portion of the lid.

In order to provide a drink outlet, an outer slit is provided between the flexible structure and the interior portion of the raised lip portion when the flexible structure is in the upward position. Thus, when the flexible structure is in the upward position, the drink outlet is closed, to minimize or prevent liquid flow upward through the lid via the drink outlet. When the flexible structure is moved to the downward position, a drink outlet is defined between the interior portion of the raised lip portion, and the flexible structure. At the same time, the flexible structure, located in the downward, drink outlet open position, provides a drink well. Overall, the flexible structure includes an outer end which is positionable, and when in the upward, closed position, it substantially prevents, or at least minimizes, the upward flow of liquid from the interior of a beverage cup through the drink outlet. Thus, direct splash of liquid from the interior of a beverage cup, outward through the drink outlet, is effectively prevented, with a flexible structure which is easily and cleanly manipulable by a user.

BRIEF DESCRIPTION OF THE DRAWING

The present invention(s) will be described by way of exemplary embodiments, using for illustration the accompanying drawing in which like reference numerals denote like elements, and in which.

Figure 1:
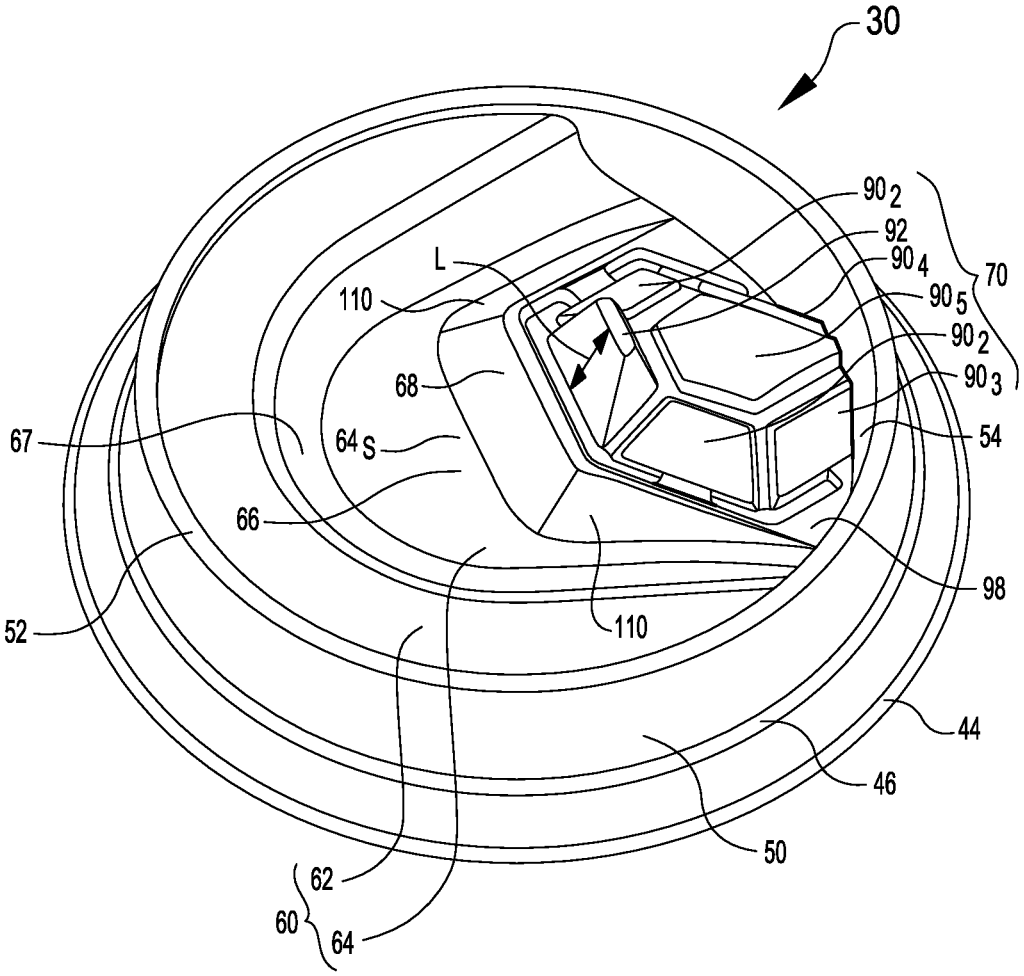
FIG. 1 is a perspective view of an embodiment for a drink-through lid for use with a cup, the lid having a drink well formed by a flexible structure when in a downward, drink outlet open position, and into which liquid emerges for consumption, and which illustrates the unique location for a flexible structure having a manual actuator which is configured and spaced, to avoid interference with the nose of a user when the drink outlet is in the open position.

The foregoing figures, being merely exemplary, contain various elements that may be present or omitted from a final configuration for a drink-through disposable lid suitable for use with a spill resistant flexible structure which is reversibly positionable between a drink outlet closed position and a drink outlet open position, using the principles described herein, or that may be implemented in various embodiments described herein for such drink-through lids. Other variations in drink-through lid designs with spill resistant features may use slightly different mechanical structures, angular configurations, mechanical fit arrangements, liquid flow configurations, or vapor flow configurations, and yet employ the principles described herein and as generally depicted in the drawing figures provided. An attempt has been made to draw the figures in a way that illustrates at least those elements that are significant for an understanding of exemplary drink-through lid with spill resistant flexible structures for use on beverage containers. Such details may be quite useful for providing high quality improved beverage container drink-through lids with spill resistant flexible structures, for use in both minimizing spills, and enabling a user to reclose the lid after initially drinking through the lid.

Thus it should be understood that various features may be utilized in accord with the teachings hereof, as may be useful in different embodiments as useful for various sizes and shapes of cups, various drink-through lids, and various spill resistant flexible structures, within the scope and coverage of the teachings herein as defined by the claims.

DETAILED DESCRIPTION OF THE INVENTION

Figure 7:
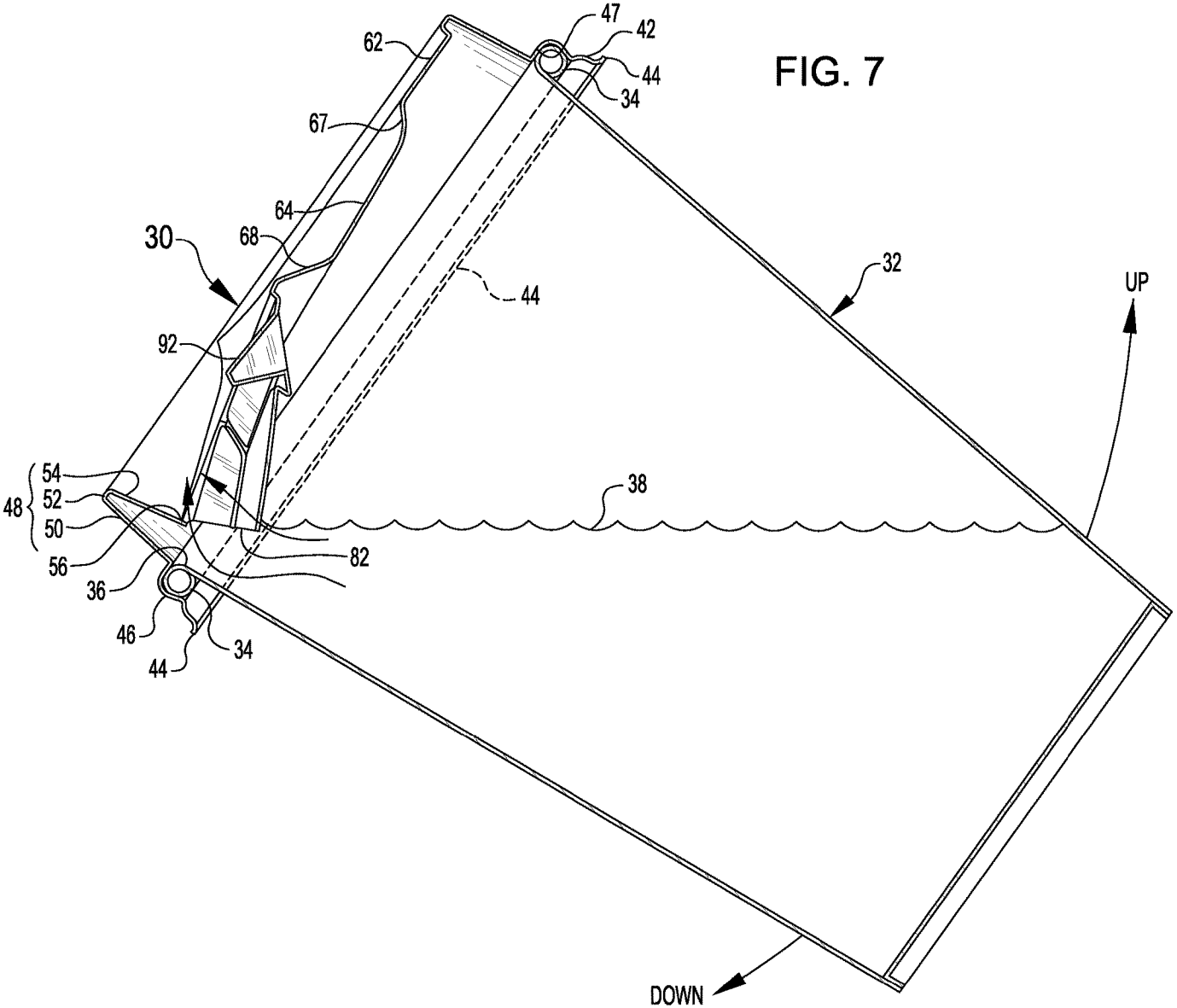
FIG. 7 is cross-sectional view of an embodiment for a drink-through lid for a beverage container having liquid therein, and showing the flexible structure in a downward position in which liquid emerges through a drink outlet for consumption, at locations above the flexible structure and below a drink outlet defining slit in the raised lip portion.

Attention is directed to FIG. 7, which provides a cross-sectional view for an embodiment of a drink-through lid 30.

The lid 30 may be used for covering a beverage cup 32 having a sealing bead 34 circumscribing the open end 36. The beverage cup is suitable for containing a liquid 38 such as hot coffee. The drink-through lid 30 has a base 40 with a rim 42 having a bottom edge 44 and an interior bead sealing portion 46 having an upper edge 47. The base 40 is sized and shaped to sealingly engage the open end 36 of the beverage cup 32. The lid 30 has a raised lip portion 48 having an exterior portion 50 extending upwardly from the base 40, an outer lip portion 52, and an interior portion 54 sloping downwardly from the outer lip portion 52 to lower end portions 56.

Figure 2:
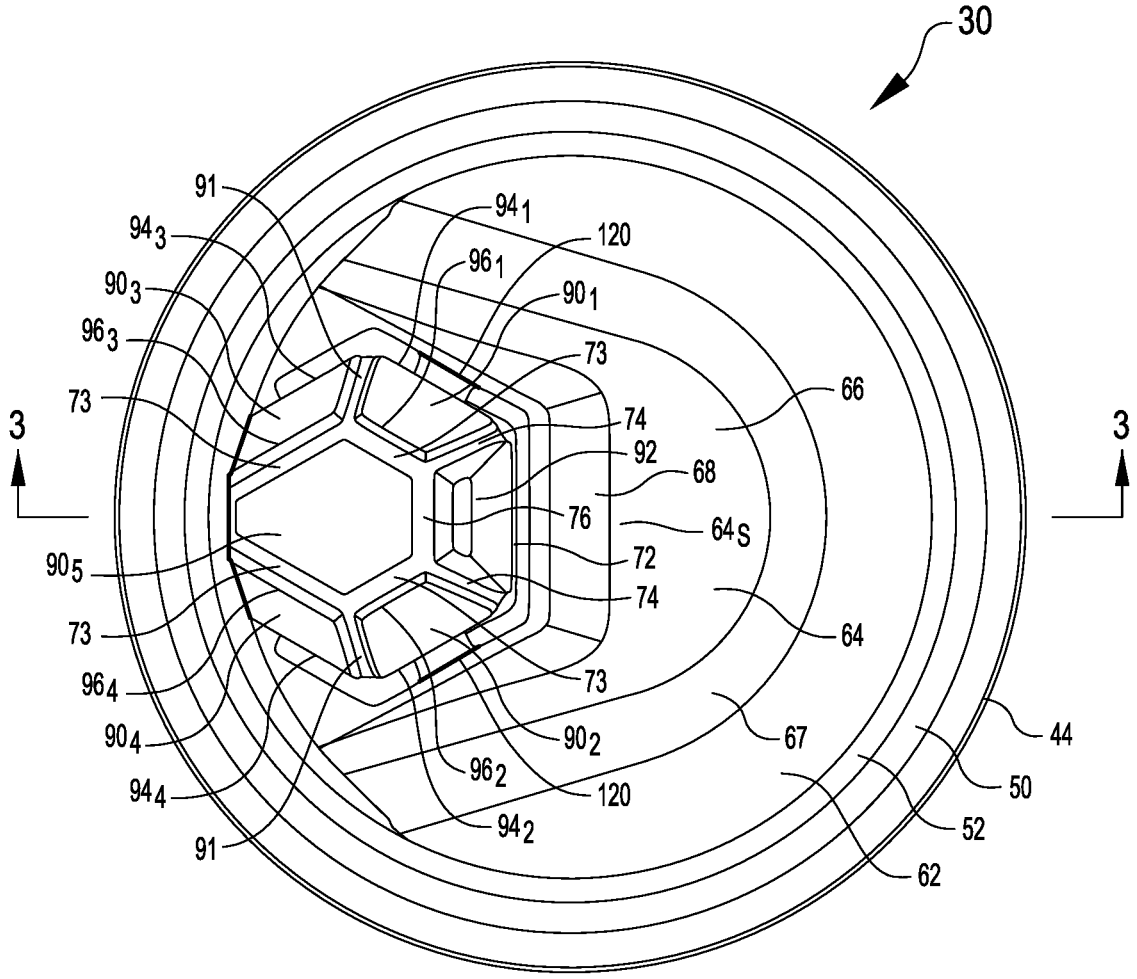
FIG. 2 is a top plan view of an embodiment for a drink-through lid for use with a cup, showing the lid which provides a manually operated actuator to reposition a flexible structure from an upward position where a drink outlet is closed, to a downward position (see FIGS. 4 and 5) where a drink outlet is open; this view shows an advantageous location for a flexible structure that provides such functionality.
Figure 3:
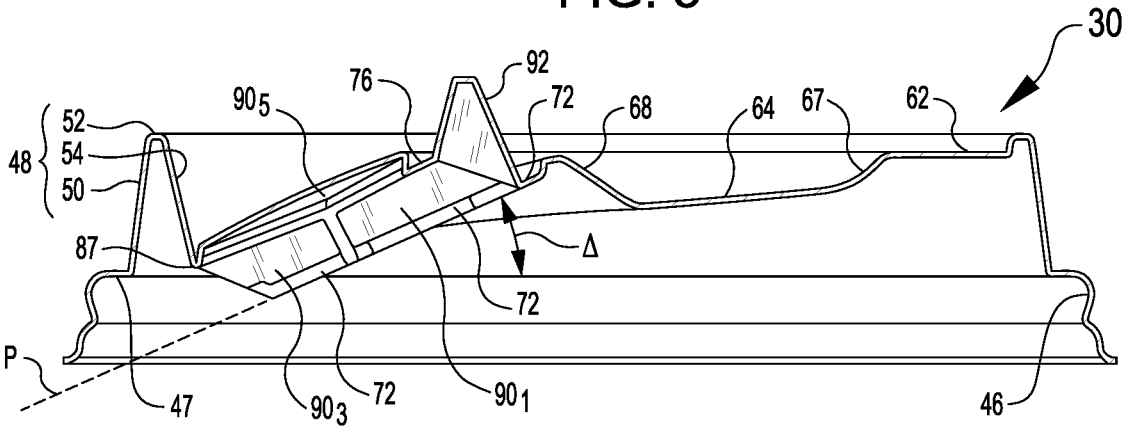
FIG. 3 is a vertical cross-sectional view, taken through section 3-3 of FIG. 2, showing an embodiment for a flexible structure in a drink-through lid for use with a cup, showing the lid which provides a manually operated actuator to reposition a flexible structure from an upward position where a drink outlet is closed, as also illustrated in FIG. 2 above.

As better seen in FIGS. 1, 2, and 3 the lid 30 includes a cover 60 which extends over substantial portion of the lid 30. The cover 60 includes a deck 62 extending inwardly from the raised lip portion 48, and a sump portion 64 located in an interior section 66 of the cover 60, and of deck 62. As the name implies, the sump portion 64 is positioned to slope downwardly from the deck 62. A sloping sidewall 67 may be provided as part of sump portion 64, to transition the lid 30 cover 60 from the height of the deck 62 to the sump portion 64. In an embodiment, the sump portion 64 may include a frame 68, for added stiffness adjacent a flexible structure 70. In any event, the flexible structure 70 includes, and is connected to the sump portion 64 using a plurality of hinges, for example hinge 72, and also includes the various hinges which adjustably connect the panels (further described below) in the flexible structure 70. In an embodiment, at least some of the plurality of hinges 72 are located along a plane P oriented downward at an angle delta A toward the raised lip portion 48, when compared to a reference plane $H_0$ (see FIG. 6), wherein reference plane $H_0$ is located at an upper edge 47 of the interior bead sealing portion 46.

Figure 4:
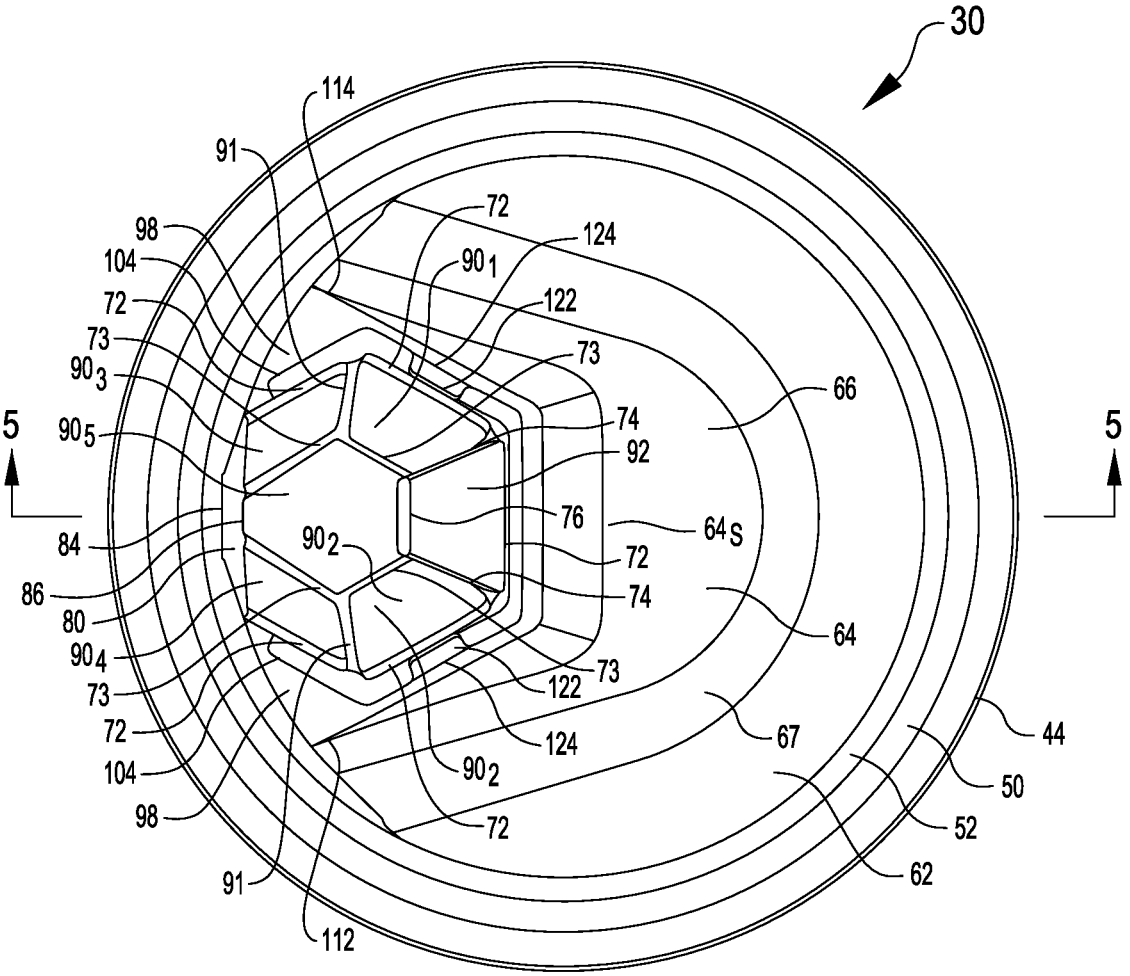
FIG. 4 is a top plan view of an embodiment for a drink-through lid for use with a cup, showing the lid as just illustrated in FIGS. 2 and 3 above, but now showing the manually operated actuator after it has been used to reposition the flexible structure from an upward position where a drink outlet is closed (see FIGS. 2 and 3), to a downward position where a drink outlet is open; this view again shows an advantageous location for a flexible structure that provides such functionality.
Figure 6:
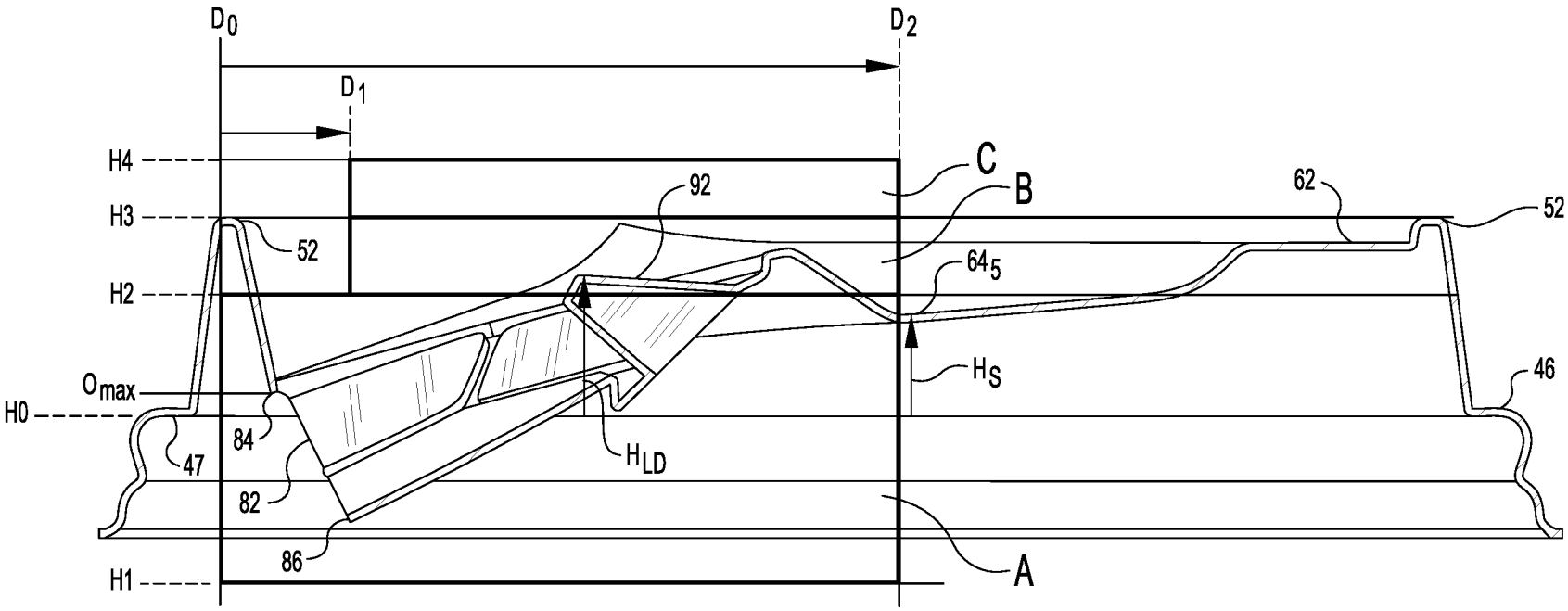
FIG. 6 again shows a vertical cross-sectional view, taken through the same location as section 5-5 in FIG. 4 just described above, but now also showing a shaded area in which a flexible structure in a drink-through lid may be advantageously located, illustrating the flexible structure location by use of a coordinate system which spatially defines the locations of each of a plurality of stacked polygons, which in an embodiment may be rectangular in shape, with a horizontal reference level $H_0$ at the upper edge of the sealing bead, for use in defining the height of the flexible structure above and below the reference level $H_0$, and a vertical reference level $D_0$ at the raised lip portion, for use in defining the distance of the flexible structure from the raised lip portion.

As seen in FIG. 4, the flexible structure 70 extends from the plurality of hinges 72 to a drink outlet 80. In an embodiment, the drink outlet 80 may be defined by and between the outer end 82 of the flexible structure 70 (by one or more components thereof, as further discussed below), and by an outer slit 84 in the interior portion 54 of the raised lip portion 48. In an embodiment, as better appreciated by reference to FIG. 6, the outer slit 84 at the drink outlet 80 has a maximum height $O_{max}$ above reference plane $H_0$ which is located at an upper edge 47 of the interior bead sealing portion 46. As also shown in FIG. 6, in an embodiment the maximum height $O_{max}$ of the drink outlet 80 is at least a distance of $H_2$ (the height of $H_2$ above reference plane $H_0$), or greater, below the height $H_3$ (the height of the outer lip portion 52 of the raised lip portion 48 above the reference plane $H_0$ at the upper edge 47 of the interior bead sealing portion 46). In an embodiment, the height $H_2$ is 0.4 inches or more below the height $H_3$ of the outer lip portion 52.

The outer slit 84 is provided between the flexible structure 70 and the interior portion 54 of the raised lip portion 48. This provides a spill resistant closure when the flexible structure 70 is positioned upwardly. When the flexible structure 70 is positioned as a downwardly shaped flexible structure 70, the outer slit 84 defines a drink outlet 80 between the inner portion 54 of raised lip portion 48, and the outer edge 86 of the flexible structure 70. Thus, opposed engagement edges, namely an upper drink outlet edge 87 at outer slit 84 on the interior portion 54 of the raised lip portion 48, and a lower drink outlet at the outer edge 86 of the flexible structure 70, provide a drink outlet sealing structure which resists passage of a liquid therethrough. The flexible structure 70 defines a significant portion, if not all of the floor of a drink well 88. In an embodiment, the lower reaches 98 (see FIG. 1 or 4) of sump portion 64 may also provide a portion of the floor of a drink well 88. Thus, the flexible structure 70, when located in the downward drink outlet 80 open position, is sized, shaped, and located to drain liquid from the flexible structure 70 into a cup 32 located therebelow. The design described herein for lid 30 also uniquely provides a flexible structure 70 which is sufficiently flexible so that the flexible structure 70 is reversibly positionable between an upward, closed position (see FIGS. 1, 2, and 3), and a downward, open position (see FIGS. 4, 5, 6, and 7) wherein a drink outlet 80 is provided in said interior portion 54 of said raised lip portion 48, yet is sufficiently stiff so that the flexible structure 70 remains positioned at either an upward closed position or in a downward open position, as positioned by a user using lever 92.

In an embodiment, the flexible structure 70 may be provided by a plurality of polygonal panels (see panels $\mathbf{90}_1$, $\mathbf{90}_2$, $\mathbf{90}_3$, $\mathbf{90}_4$, $\mathbf{90}_5$, in FIGS. 2 and 4), and a lever 92. The polygonal panels $\mathbf{90}_1$, $\mathbf{90}_2$, $\mathbf{90}_3$, $\mathbf{90}_4$, $\mathbf{90}_5$ in the flexible structure 70 may be provided as flat panels. In various embodiments, the plurality of polygonal panels $\mathbf{90}_1$, $\mathbf{90}_2$, $\mathbf{90}_3$, $\mathbf{90}_4$, and $\mathbf{90}_5$ may include outer members (panels $\mathbf{90}_1$, $\mathbf{90}_2$, $\mathbf{90}_3$, $\mathbf{90}_4$, in FIGS. 2 and 4) and one or more central members (panel $\mathbf{90}_5$ in FIGS. 2 and 4). The outer members $\mathbf{90}_1$, $\mathbf{90}_2$, $\mathbf{90}_3$, $\mathbf{90}_4$ have an outer edge $\mathbf{94}_1$, $\mathbf{94}_2$, $\mathbf{94}_3$, and $\mathbf{94}_4$. The outer edges $\mathbf{94}_1$, $\mathbf{94}_2$, $\mathbf{94}_3$, and $\mathbf{94}_4$ are joined via hinges 72 to the sump portion 64. Each of the outer members $\mathbf{90}_1$, $\mathbf{90}_2$, $\mathbf{90}_3$, and $\mathbf{90}_4$ have an inner edge $\mathbf{96}_1$, $\mathbf{96}_2$, $\mathbf{96}_3$, and $\mathbf{96}_4$ which are joined via hinges 73 to the one or more central members $\mathbf{90}_5$. As seen in FIGS. 2 and 4, adjacent outer members (e.g., $\mathbf{90}_1$ and $\mathbf{90}_3$, as well as $\mathbf{90}_2$ and $\mathbf{90}_4$), are flexibly joined with a hinge 91 therebetween. The lever 92 is joined by at least one hinge 72 to the sump portion 64. The lever 92 is also joined by hinges 74 to adjacent outer members $\mathbf{90}_1$ and $\mathbf{90}_2$. The lever 92 is also joined by at least one hinge 76 to the one or more central members $\mathbf{90}_5$. As seen in FIG. 6, in an embodiment the lever 92 is positioned below the height $H_3$ of the raised lip portion 48 when the flexible structure 70 is positioned as a downwardly shaped structure.

Figure 12:
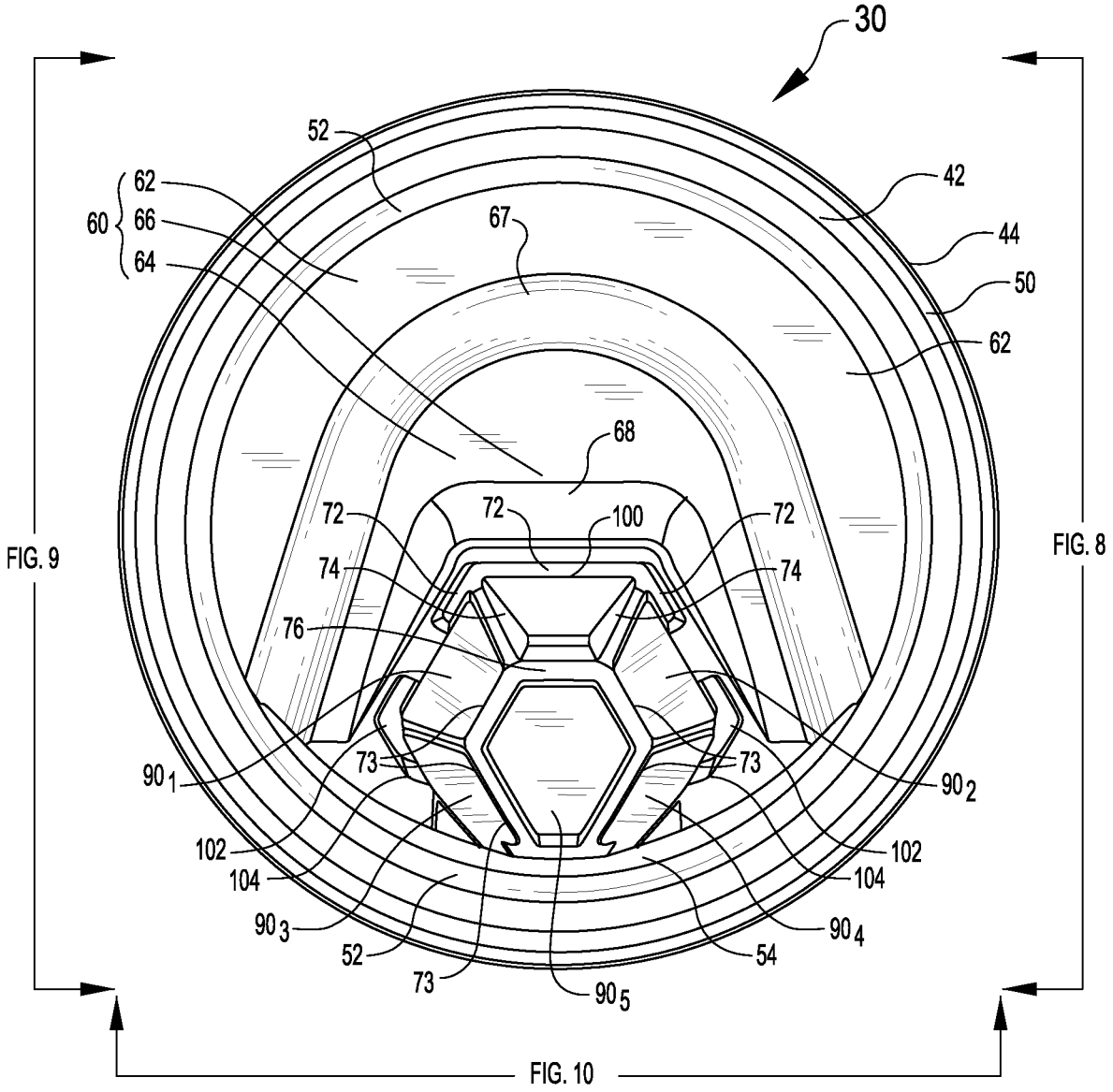
FIG. 12 is a top plan view of an embodiment for a drink-through lid for use with a cup, showing from above the lid configuration illustrated in FIGS. 8, 9, 10, and 11, showing a deck portion and a sump portion, as well as a view of the flexible structure and the actuator for the flexible structure.

As seen in FIGS. 2, 4, and 12, the outer members $\mathbf{90}_1$, $\mathbf{90}_2$, $\mathbf{90}_3$, and $\mathbf{90}_4$ include upper outer members $\mathbf{90}_1$ and $\mathbf{90}_2$, and lower outer members $\mathbf{90}_3$ and $\mathbf{90}_4$. In an embodiment, the upper outer members $\mathbf{90}_1$ and $\mathbf{90}_2$ may be provided in the form of trapezoidal shaped polygonal panels. In an embodiment, the lower outer members $\mathbf{90}_1$ and $\mathbf{90}_2$ may be provided as parallelogram shaped polygonal panels. In an embodiment, the one or more central members $\mathbf{90}_5$ may be provided in the form of a hexagonal shaped panel. In an embodiment, the hexagonal shaped panel of the one or more central members $\mathbf{90}_5$ may be in the shape of an irregular hexagon.

Figure 5:
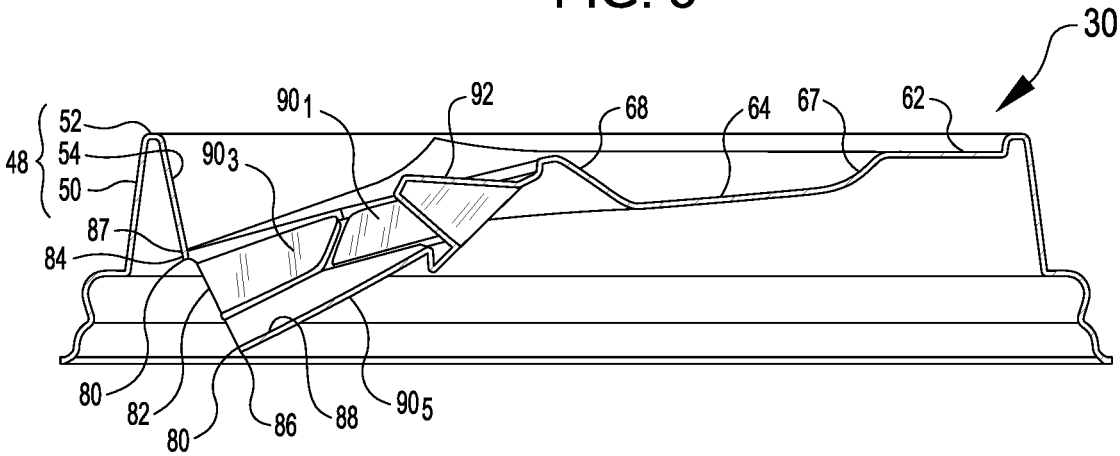
FIG. 5 is a vertical cross-sectional view, taken through section 5-5 of FIG. 4, showing an embodiment for a flexible structure in a drink-through lid for use with a cup, where the flexible structure has been positioned in a downward, generally concave shape to provide a drink well, and in part defines a drink outlet through which liquid from the cup may pass for consumption by a user.
Figure 8:
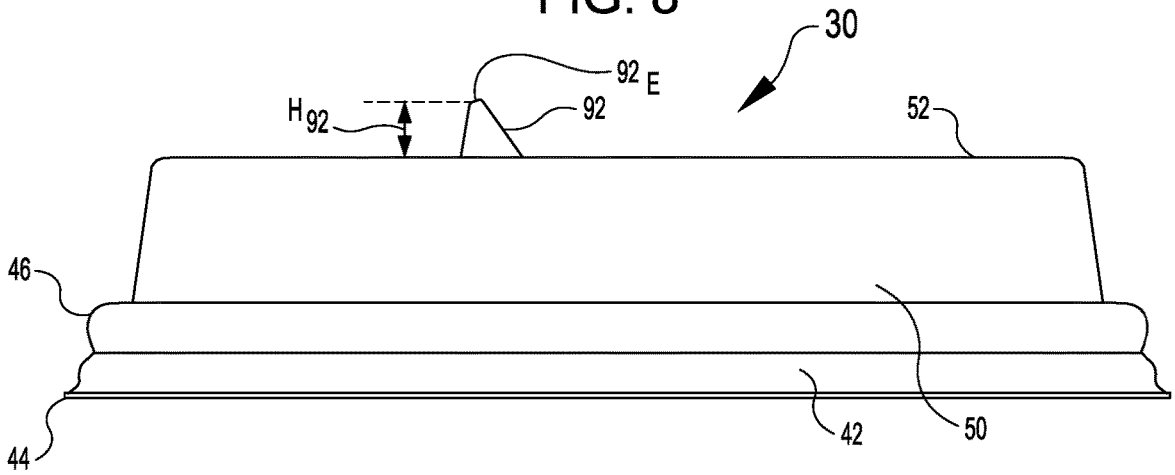
FIG. 8 is a right side elevation view of an embodiment for a drink-through lid for use with a cup, taken from the perspective of reference arrow "FIG. 8" in FIG. 12, showing an actuator for a flexible structure in the upward position, wherein a flexible structure (see FIGS. 2 and 3) is positioned so that the drink outlet is closed by the flexible structure.
Figure 9:
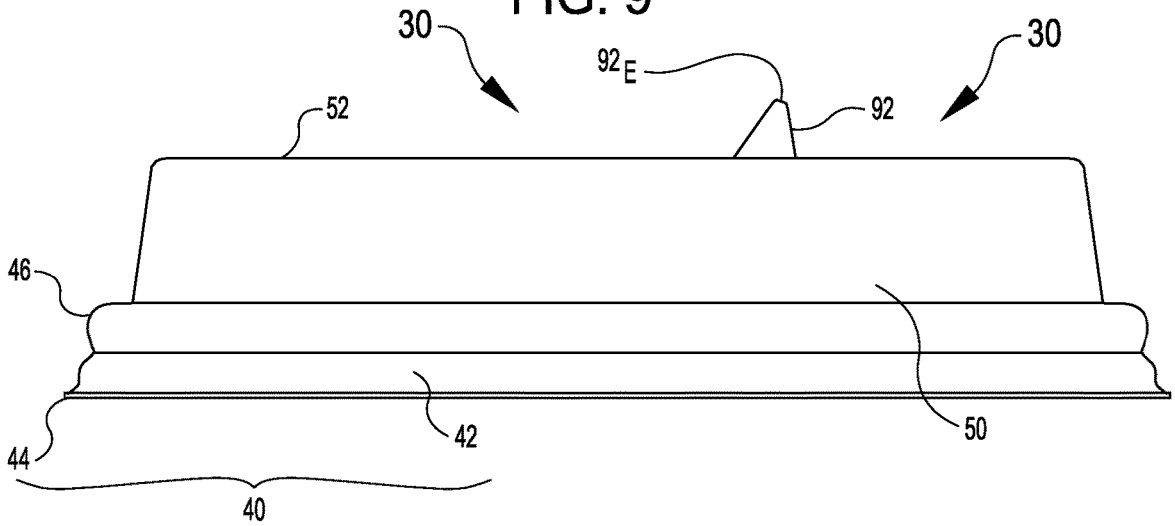
FIG. 9 is a left side elevation view of an embodiment for a drink-through lid for use with a cup, taken from the perspective of reference arrow "FIG. 9" in FIG. 12, showing an actuator for a flexible structure in the upward position, wherein a flexible structure (see FIGS. 2 and 3) is positioned so that the drink outlet is closed by the flexible structure.
Figure 10:
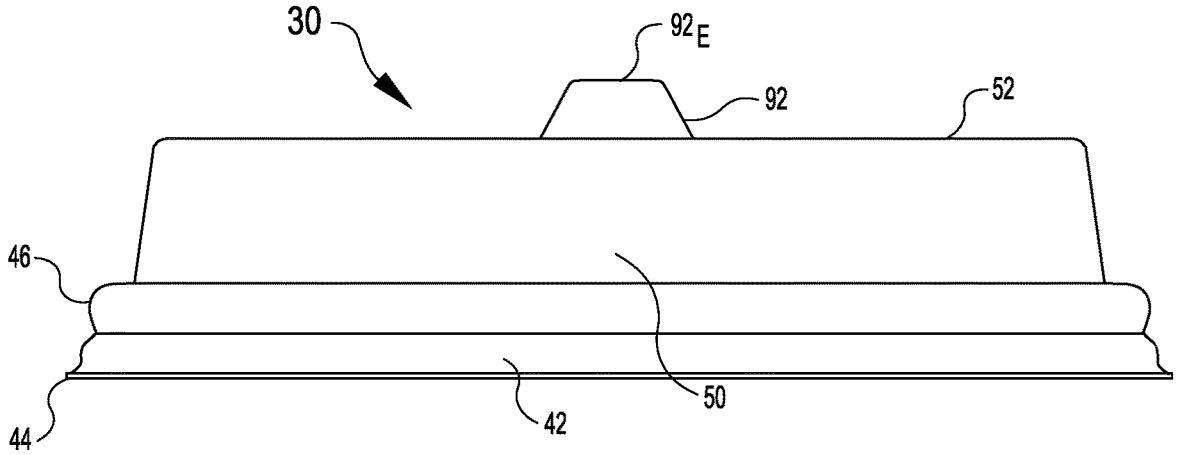
FIG. 10 is a front elevation view of an embodiment for a drink-through lid for use with a cup, taken from the perspective of reference arrow "FIG. 10" in FIG. 12, showing an actuator for a flexible structure in the upward position, rising above the raised lip portion of the lid, wherein a flexible structure (see FIGS. 2 and 3) is positioned so that the drink outlet is closed by the flexible structure.
Figure 11:
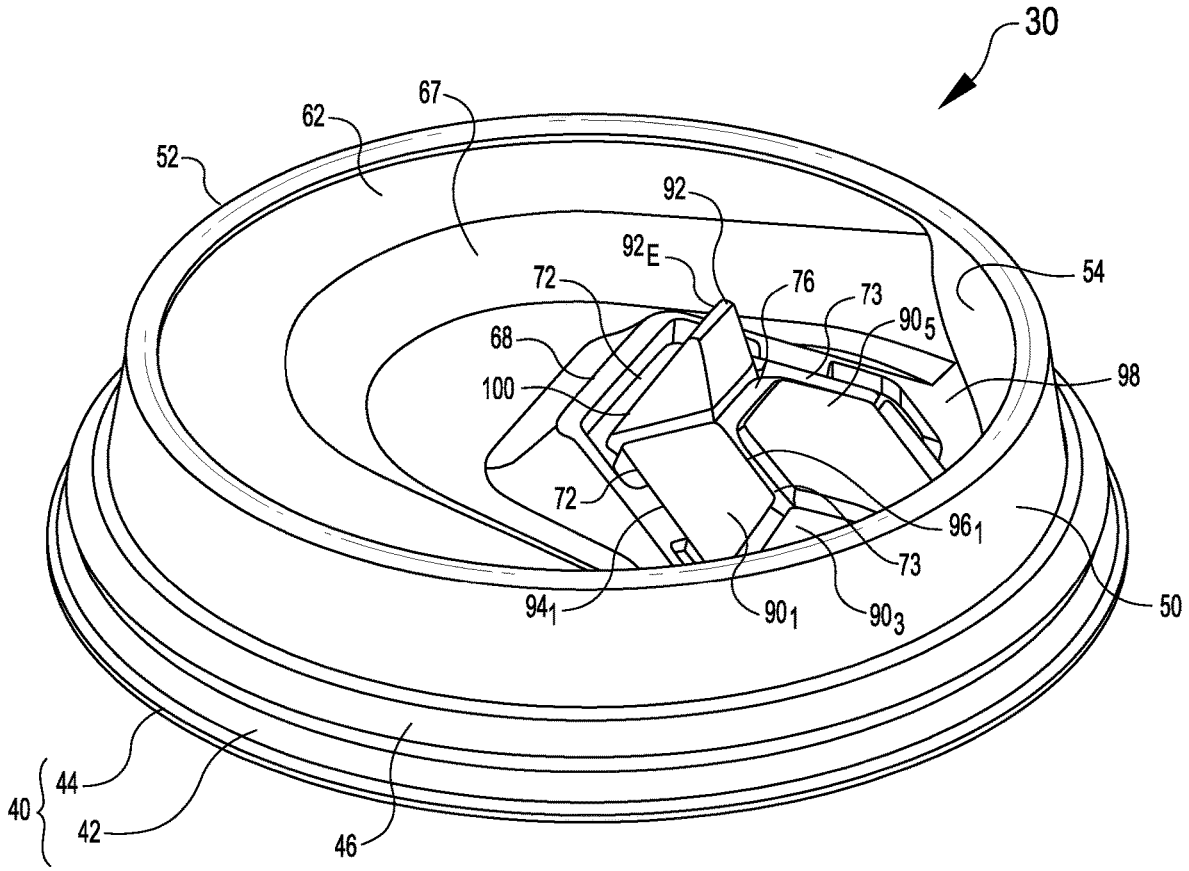
FIG. 11 is a perspective view of an embodiment for a drink-through lid for use with a cup, showing in perspective the lid configuration illustrated in FIGS. 8, 9, 10, and 12, showing a deck portion and a sump portion, as well as a view of portions of the flexible structure and actuator.

As seen in FIG. 11, and as can also be appreciated in FIG. 12, the lever 92 includes a lever base 100. In an embodiment, the lever base 100 may be trapezoidal in shape. In an embodiment, the lever 92 extends outwardly from the lever base 100 to an outer end $\mathbf{92}_E$. In an embodiment, an outer surface of lever 92, between the lever base 100 and the outer end $\mathbf{92}_E$, may be substantially shaped as a trapezoidal pyramid (see FIGS. 2 and 10). As seen in FIG. 6, when the flexible structure 70 is positioned as a downwardly shaped flexible structure 70, as illustrated in FIGS. 4, 5, and 6, the outer end of the lever has a height $H_{LD}$. In this configuration, the sump portion 64, at a location radially inward from the drink outlet 80, has an upper surface $\mathbf{64}_S$ at a height Hs which is below height $H_{LD}$. On the other hand, when the flexible structure 70 is positioned as an upwardly shaped flexible structure 70, the outer end $\mathbf{92}_E$ of the lever 92 is positioned at an elevation $H_{92}$ above the height of the raised lip portion 48, as shown in FIG. 8.

In an embodiment, a frame 68 may be provided in sump portion 64. In such an embodiment, at least some of the plurality of hinges 72 connect to the sump portion 64 via attachment to frame 68. The frame 68, located in sump portion 64, may be at least partially configured in the shape of the lower portion of a truncated A-frame, and wherein the frame further includes, beyond the lower ends 102 of the truncated A-frame portion, inwardly directed pincer portions 104. In an embodiment, the lower outer members $\mathbf{90}_3$ and $\mathbf{90}_4$ are hingedly affixed to the frame 68 from one of the inwardly directed pincer portions 104. As earlier noted, the sump portion 64 may include lower sump portions 98. Such lower sump portions 98 are located adjacent the inwardly directed pincer portions 104. In an embodiment, the lower sump portions 98 and the inwardly directed pincer portions 104 are oriented along a common plane P, as seen in FIG. 3. As can be appreciated from FIGS. 3 and 6, the common inclined plane P slopes downward toward the drink outlet at an angle delta (A), as compared to the reference plane $H_0$. In an embodiment, the frame 68 further comprises a strengthening shoulder 110, which rises upwardly from the sump portion 64. In an embodiment, seen in FIG. 4, the strengthening shoulder 110 is provided in a U-shape with outwardly flared first 112 and second 114 ends. In an embodiment, some or all of the plurality of hinges 72 connected to the sump portion 64 are provided on a common plane P oriented downward at an angle delta (A) when compared to reference plane $H_0$. In an embodiment, the angle delta (A) is between about ten degrees and about forty five degrees. In an embodiment, the angle delta (A) is between about fifteen degrees and sixty degrees. In an embodiment, the angle delta (A) is between about fifteen degrees and forty degrees. In an embodiment, the angle delta (A) is between about twenty degrees and thirty five degrees. In an embodiment, the angle delta (A) is about thirty degrees. In an embodiment, when using a frame 68 with a plurality of hinges 72, at least some of the plurality of hinges are connected to the frame 68 in the sump portion 64 of the cover 60 along a common plane P that is inclined downward at an angle delta (A) when compared to reference plane $H_0$, and wherein the angle delta (A) is between about ten degrees and forty five degrees.

As seen in FIG. 1, in an embodiment, the lever 92 may be providing having a length L, measured from an outer surface of a hinge 72 joining the lever 92 to the sump portion 64 to the outer end of the lever $\mathbf{92}_E$, is about one-half inch, or less. In an embodiment, the lever 92 may be provided in a length L, of about three-eighths of an inch, or less. Generally, the lever 92 and plurality of polygonal panels (see panels $\mathbf{90}_1$, $\mathbf{90}_2$, $\mathbf{90}_3$, $\mathbf{90}_4$, and $\mathbf{90}_5$, in FIGS. 2 and 4) of the flexible structure 70 provide, in combination, a snap action alternate position for the flexible structure 70, between an upward drink outlet closed position, and a downward drink outlet open position, wherein the flexible structure 70 is stable at either position, when moved thereto. The flexible structure 70 may be provided using integrally formed connected components. In an embodiment, the various components of the lid 30, including the flexible structure 70, base 40, raised lip portion 48, cover 60, and frame 68 all comprise interconnected and integrally thermoformed components.

As shown in FIGS. 2 and 4, in an embodiment, one or more vent slits 120 may be provided. The vent slits 120 may be located between an outer edge $\mathbf{94}_1$ and $\mathbf{94}_2$ of one or both of the outer members $\mathbf{90}_1$ and $\mathbf{90}_2$, and the sump portion 64. In an embodiment, vent openings 122 may be provided. Each of the one or more vent openings 122 may be defined by vent edgewalls 124 when the vent openings 122 are located between an outer edge $\mathbf{94}_1$ and $\mathbf{94}_2$ of one of the outer members $\mathbf{90}_1$ and $\mathbf{90}_2$ and the frame 68.

Figure 6A:
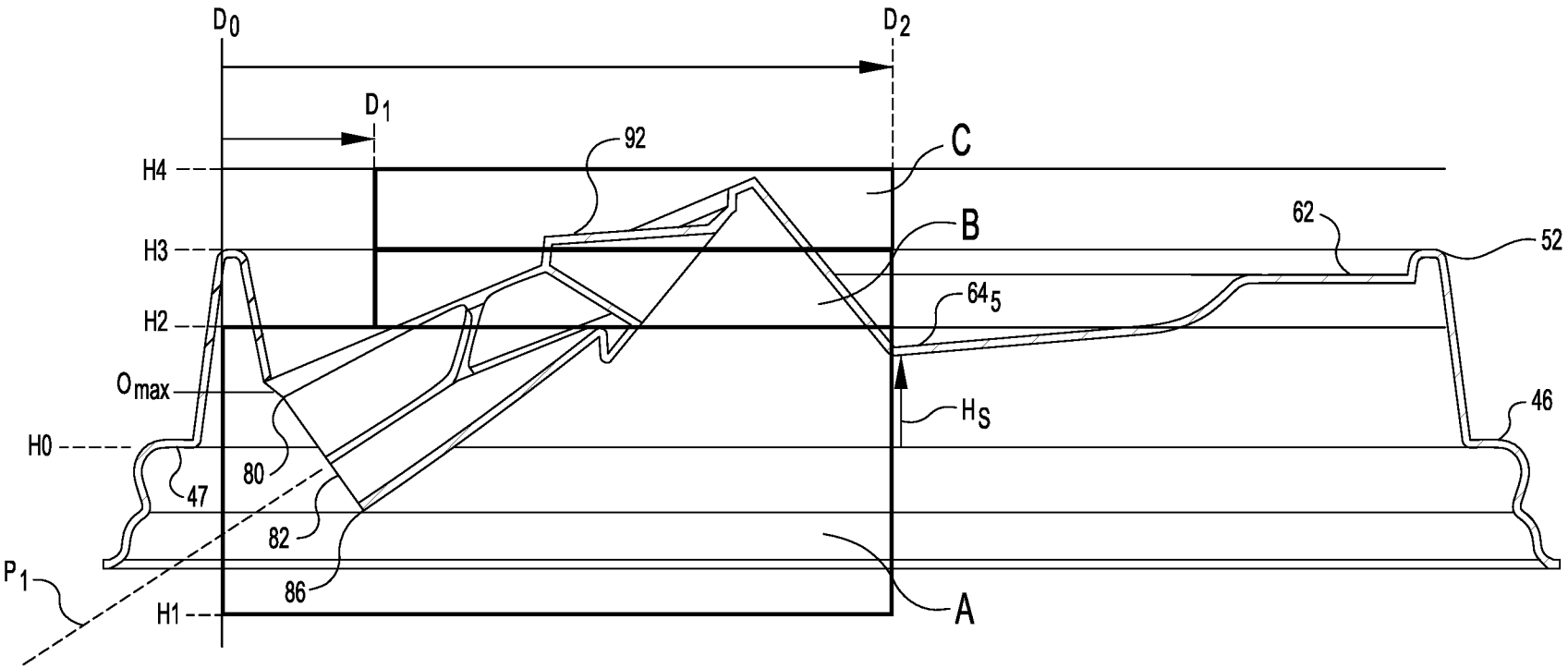
FIG. 6A again shows a vertical cross-sectional view, similar to the view just shown in FIG. 6 above, now additionally showing an area in which a flexible structure in a drink-through lid may be advantageously located, illustrating the flexible structure location by use of a coordinate system which spatially defines the locations of each of a plurality of stacked polygons, which in an embodiment may be rectangular in shape, with a horizontal reference level $H_0$ at the upper edge of the sealing bead, for use in defining the height of the flexible structure above and below the reference level $H_0$, and a vertical reference level $D_0$ at the raised lip portion, for use in defining the distance of the flexible structure from the raised lip portion.

The unique flexible structure 70 described herein is configured in a compact design within space limitations as depicted in FIG. 6. Other unique relationships between the lever 92 and the sump portion 64 in lid 30 are also shown in FIG. 6, as described above. When the flexible structure 70 is positioned as a downwardly shaped flexible structure 70, the flexible structure 70 is located within a flexible structure location defined radially inward from the outer lip portion 52 of the raised lip portion 48 by a plurality of stacked polygons configured as shown in FIG. 6 or 6A. The stacked polygons are each defined by a set of coordinates, namely polygon A with coordinates ($H_1$, $D_0$), ($H_1$, $D_2$), ($H_2$, $D_2$), and ($H_2$, $D_0$), polygon B with coordinates ($H_2$, $D_1$), ($H_2$, $D_2$), ($H_3$, $D_2$), and ($H_3$, $D_1$), and polygon C with coordinates ($H_3$, $D_1$), ($H_3$, $D_2$), ($H_4$, $D_2$), and ($H_4$, $D_1$). The relationships of the dimensions of the locations of polygons A, B, and C are configured so that $D_1$ is 0.5 inches or more from $D_0$,
$D_2$ is 1.8 inches or less from $D_0$,
$H_4$ is 0.2 inches or less above $H_3$,
$H_3$ is even with, or below, the raised lip portion,
$H_2$ is 0.2 inches or more below $H_3$, and
$H_1$ is 0.5 inches or less below $H_0$.

In an embodiment, $D_2$ may be 1.6 inches or less from Do. In an embodiment, $D_2$ may be 1.4 inches or less from Do. In an embodiment, $H_2$ is 0.3 inches or more below $H_3$. In an embodiment, $H_2$ is 0.4 inches or more below $H_3$. In an embodiment, at least some of the polygons are rectangles. In an embodiment, the flexible structure 70 may be located within a flexible structure location as shown in FIG. 6 as polygon A and polygon B, with coordinates as noted above. In an embodiment, all of the polygons may be rectangles. As noted above, in an embodiment, the drink outlet 80 provided by outer slit 84 has a maximum height $O_{max}$ above height $H_0$. Also, the maximum height $O_{max}$ of drink outlet 80 is at least a distance of $H_2$, or more, below the height $H_3$. In an embodiment, height $H_2$ is 0.4 inches or more below height $H_3$.

As shown in FIG. 6A, in an embodiment, common plane $P_1$ is inclined downward at an angle delta (Δ) when compared to reference plan $H_0$ that is steeper than the angle for the common plane P shown in FIG. 3. The steeper common plane $P_1$ results in portions of the flexible structure extending into polygon C when the flexible structure is positioned as a downwardly shaped flexible structure, as shown in FIG. 6A. Various embodiments may extend the flexible structure into polygon C when the flexible structure is positioned as a downwardly shaped flexible structure, for example, by raising the flexible structure shown in FIG. 6 so that it is closer to reference plane $H_4$ [not shown], or by increasing the height of said plurality of outer member polygonal panels $\mathbf{90}_1$, $\mathbf{90}_2$, $\mathbf{90}_3$, and $\mathbf{90}_4$ [not shown].

Various embodiments may be provided using various types of plastics. Suitable plastics may be thermoplastics. In various embodiments, the combination of a lid and beverage cup may be disposable, in that they are intended only for a single use. For such uses, very inexpensive thermoplastic materials may be suitable for construction of the lids 30. Other than the exemplary structural techniques just mentioned above for facilitating manufacture of lid designs as taught herein, the processes for manufacturing such goods are well known in the art, and thus will not be further explained herein. However, those skilled in the art will recognize that various embodiments may be manufactured using other processes, and consequently, the invention is not limited to any particular method of manufacture.

In the foregoing description, for purposes of explanation, numerous details have been set forth in order to provide a thorough understanding of the disclosed exemplary embodiments for the design of a disposable lid with flexible structure for minimizing or eliminating spills through a flexible but closed drink-through lid, while allowing the lid to be opened and closed, repeatedly during use. However, certain of the described details may not be required in order to provide useful embodiments, or to practice selected or other disclosed embodiments. Further, for descriptive purposes, various relative terms may be used. When used in a descriptive manner, such terms are provided to facilitate understanding of the various aspects of the disclosed embodiments. And, various actions or activities in any method described herein may have been described as multiple discrete activities, in turn, in a manner that is most helpful in providing an understanding of the embodiment. However, the order of description should not be construed as to imply that such activities are necessarily order dependent. In particular, certain operations may not necessarily need to be performed precisely in the order of presentation. Also, the reader will note that the phrase "in an embodiment" or "in one embodiment" has been used repeatedly. This phrase generally does not necessarily refer to the same embodiment, however, it may. Finally, the terms "comprising", "having" and "including" should be considered synonymous, and open ended, and thus should be interpreted to mean "including, but not limited to", unless the context expressly dictates otherwise.

From the foregoing, it can be understood by persons skilled in the art that a novel beverage container lid 30, and flexible structure 70 design to provide spill resistance while in use with a beverage cup 32, have been described herein. Although only certain specific embodiments of the present invention have been shown and described, there is no intent to limit this invention by these embodiments. Rather, the invention is to be defined by the appended claims and their equivalents when taken in combination with the description.

Importantly, the aspects and embodiments described and claimed herein may be modified from those shown without materially departing from the novel teachings and advantages provided, and may be embodied in other specific forms without departing from the spirit or essential characteristics thereof. More generally, other flexible structure designs may be configured using the teachings hereof and are thus intended to be included with the breadth of appropriate claims as set forth below. Therefore, the embodiments presented herein are to be considered in all respects as illustrative and not restrictive or limiting. As such, this disclosure is intended to cover the structures described herein and not only structural equivalents thereof, but also equivalent structures.

Numerous modifications and variations are possible in light of the above teachings. Therefore, the protection afforded to this invention should be limited only by the claims set forth herein, and the legal equivalents thereof.

The invention claimed is:

1. A drink-through lid for a beverage cup having an open end, with a sealing bead circumscribing the open end of the beverage cup, the drink-through lid comprising:

(a) a base comprising a rim having a bottom edge and an interior bead sealing portion, the base sized and shaped to sealingly engage the open end of the beverage cup;

(b) a raised lip portion having an exterior portion extending upwardly from the base, an outer lip portion, and an interior portion sloping downwardly from the outer lip portion to lower end portions;

(c) a cover, the cover providing (1) a deck extending inwardly from the raised lip portion, and (2) a sump portion located in an interior portion of the deck;

(d) a plurality of hinges, the hinges connected to the sump portion of the cover, wherein at least some of the plurality of hinges are located along a plane P oriented downward at an angle toward the outer lip portion, when compared to a reference plane $H_0$, wherein reference plane $H_0$ is located at an upper edge of the interior bead sealing portion;

(e) a flexible structure extending from the plurality of hinges to a drink outlet end adjacent a section of the interior portion of the raised lip portion, the flexible structure comprising (1) a plurality of polygonal panels, the plurality of polygonal panels including outer members and one or more central members, and (2) a lever;

(f) wherein each of the outer members comprises an outer edge, and wherein the outer edge of each outer member is joined via a hinge to the sump portion, and wherein each of the outer members comprises an inner edge, the inner edge joined via a hinge to the one or more central members;

(g) an outer slit between the flexible structure and the interior portion of the raised lip portion, whereby when the flexible structure is positioned as a downwardly shaped flexible structure, the outer slit defines a drink outlet between the interior portion and the flexible structure, and wherein the flexible structure defines a drink well; and (h) wherein the lever is joined by at least one hinge to the sump portion, by hinges to adjacent outer members, and by at least one hinge to the one or more central members, and wherein the lever is positioned below the height of the raised lip portion when the flexible structure is positioned as a downwardly shaped structure.

2. A drink-through lid as set forth in claim 1, wherein the outer slit defines opposed engagement edges including an upper drink outlet edge on the interior portion of the raised lip portion, and a lower drink outlet edge on the flexible structure, wherein the opposed engagement edges provide a drink outlet sealing structure which resists passage of a liquid therethrough.

3. A drink-through lid as set forth in claim 1, wherein adjacent outer members are flexibly joined with a hinge therebetween.

4. A drink-through lid as set forth in claim 1, wherein the outer members comprise upper outer members and lower outer members.

5. A drink-through lid as set forth in claim 4, wherein the upper outer members comprise trapezoidal shaped polygonal panels.

6. A drink-through lid as set forth in claim 4, wherein the lower outer members comprise parallelogram shaped polygonal panels.

7. A drink-through lid as set forth in claim 1, wherein the one or more central members comprise a hexagonal shaped panel.

8. A drink-though lid as set forth in claim 7, wherein the hexagonal shaped panel comprises an irregular hexagon.

9. A drink-through lid as set forth in claim 1, wherein the lever comprises a base, and where in the base is trapezoidal in shape.

10. A drink-through lid as set forth in claim 9, wherein the lever extends outwardly from the base to an outer end, and provides an outer surface therebetween substantially shaped as a trapezoidal pyramid.

11. A drink-through lid as set forth in claim 10, wherein when the flexible structure is positioned as a downwardly shaped flexible structure, the outer end of the lever has a height $H_{LD}$, and wherein at a location radially inward from the drink outlet, the sump portion has an upper surface at a height Hs which is below height $H_{LD}$.

12. A drink-through lid as set forth in claim 10, wherein when the flexible structure is positioned as an upwardly shaped flexible structure, the outer end of the lever is positioned at an elevation above the height of the raised lip portion.

13. A drink-through lid as set forth in claim 10, wherein the lever has a length L, measured from an outer surface of a hinge joining the lever to the sump portion to the outer end of the lever, is about one-half inch, or less.

14. A drink-through lid as set forth in claim 10, wherein the lever has a length L, measured from an outer surface of the hinge joining the lever to the sump portion to the outer end of the lever, is about three-eighths of an inch, or less.

15. A drink-through lid as set forth in claim 1, wherein the sump portion further comprises a frame, and wherein at least some of the plurality of hinges are attached to the frame.

16. A drink-through lid as set forth in claim 15, wherein the frame is located within the sump portion of the cover, and wherein the frame is at least partially configured in the shape of the lower portion of a truncated A-frame, and wherein the frame further comprises, beyond the lower end of the truncated A-frame portion, inwardly directed pincer portions.

17. A drink-through lid as set forth in claim 16, wherein lower outer members are each hingedly affixed to the frame from one of the inwardly directed pincer portions.

18. A drink-through lid as set forth in claim 17, wherein the sump portion comprises lower sump portions, and wherein the lower sump portions are located adjacent the inwardly directed pincer portions.

19. A drink-through lid as set forth in claim 18, wherein the lower sump portions and the inwardly directed pincer portions are oriented along a common plane.

20. A drink-through lid as set forth in claim 19, wherein the common plane slopes downward toward the drink outlet.

21. A drink-through lid as set forth in claim 15, wherein the frame further comprises a strengthening shoulder, the strengthening shoulder upwardly rising from the sump portion.

22. A drink-through lid as set forth in claim 21, wherein the strengthening shoulder is provided in a U-shape with outwardly flared first and second ends.

23. A drink-through lid as set forth in claim 15, wherein the at least some of the plurality of hinges are connected to the frame in the sump portion of the cover, wherein the plane P is oriented downward at an angle delta (Δ) when compared to reference plane $H_0$, wherein the angle delta (Δ) is between about ten degrees and forty-five degrees.

24. A drink-through lid as set forth in claim 15, further comprising one or more vent openings, each of the one or more vent openings defined by vent edgewalls, the vent openings located between an outer edge of one of the outer members, and the frame.

25. A drink-through lid as set forth in claim 1, wherein the hinges connected to the sump portion of the cover, wherein the plane P is oriented downward at an angle delta (Δ) when compared to reference plane $H_0$, wherein the angle delta (Δ) is between about ten degrees and forty-five degrees.

26. A drink-through lid as set forth in claim 1, wherein the hinges connected to the sump portion of the cover, wherein the plane P is oriented downward at an angle delta (Δ) when compared to reference plane $H_0$, wherein the angle delta (Δ) is between about fifteen degrees and sixty degrees.

27. A drink-through lid as set forth in claim 1, wherein the plane P is oriented downward at an angle delta (Δ) when compared to reference plane $H_0$, wherein the angle delta (Δ) is between about fifteen degrees and forty degrees.

28. A drink-through lid as set forth in claim 1, wherein the plane P is oriented downward at an angle delta (Δ) when compared to reference plane $H_0$, wherein the angle delta (Δ) is between about twenty degrees and thirty-five degrees.

29. A drink-through lid as set forth in claim 1, wherein the plane P is oriented downward at an angle delta (Δ) when compared to reference plane $H_0$, wherein the angle delta (Δ) is about thirty degrees.

30. A drink-through lid as set forth in claim 1, wherein the lever and flexible structure provide, in combination, a snap action alternate position for the flexible structure, between an upward drink outlet closed position, and a downward drink outlet open position, wherein the flexible structure is stable at either position, when moved thereto.

31. A drink-through lid as set forth in claim 1, wherein said flexible structure comprises integrally formed connected components.

32. A drink-through lid as set forth in claim 1, wherein the flexible structure, base, raised lip portion, cover, and frame all comprise interconnected and integrally thermoformed components.

33. A drink-through lid as set forth in claim 1, further comprising one or more vent slits, each of the one or more vent slits located between an outer edge of one of the outer members, and the sump portion.

34. A drink-through lid as set forth in claim 1, wherein said flexible structure, when located in the downward drink outlet open position, is sized, shaped, and located to drain liquid from the flexible structure into a cup located therebelow.

35. A drink-through lid as set forth in claim 1, wherein the flexible structure is (a) sufficiently flexible so that the flexible structure is reversibly positionable between an upward, closed position, and a downward, open position wherein a drink outlet is provided in said interior portion of said raised lip portion, yet (b) sufficiently stiff so that said flexible structure remains positioned at either an upward closed position or in a downward open position.

36. A drink-through lid as set forth in claim 1, wherein the polygonal panels in the flexible structure comprise flat panels.

37. A drink-through lid for a beverage cup having an open end, with a sealing bead circumscribing the open end of the beverage cup, the drink-through lid comprising:

(a) a base comprising a rim having a bottom edge and an interior bead sealing portion, the base sized and shaped to sealingly engage the open end of the beverage cup;

(b) a raised lip portion having an exterior portion extending upwardly from the base, an outer lip portion, and an interior portion sloping downwardly from the outer lip portion to lower end portions;

(c) a cover, the cover providing (1) a deck extending inwardly from the raised lip portion, and (2) a sump portion located in an interior portion of the deck;

(d) a plurality of hinges, the hinges connected to the sump portion of the cover, wherein at least some of the plurality of hinges are located along a plane P oriented downward at an angle toward the outer lip portion, when compared to a reference plane $H_0$, wherein reference plane $H_0$ is located at an upper edge of the interior bead sealing portion;

(e) a flexible structure extending from the plurality of hinges to a drink outlet end adjacent a section of the interior portion of the raised lip portion, the flexible structure comprising (1) a plurality of polygonal panels, the plurality of polygonal panels including outer members and one or more central members, and (2) a lever;

(f) wherein each of the outer members comprises an outer edge, and wherein the outer edge of each outer member is joined via a hinge to the sump portion, and wherein each of the outer members comprises an inner edge, the inner edge joined via a hinge to the one or more central members;

(g) wherein the lever is joined by at least one hinge to the sump portion, by hinges to adjacent outer members, and by at least one hinge to the one or more central members;

(h) an outer slit between the flexible structure and the interior portion of the raised lip portion, whereby when the flexible structure is positioned as a downwardly shaped flexible structure, the outer slit defines a drink outlet between the interior portion and the flexible structure, and wherein the flexible structure defines a drink well; and (i) wherein the flexible structure, when configured in the downward drink outlet open position, is located within a flexible structure location defined radially inward from the raised lip portion by a plurality of stacked polygons, the stacked polygons each defined by a set of coordinates, namely polygon (A) with coordinates ($H_1$, $D_0$), ($H_1$, $D_2$), ($H_2$, $D_2$), and ($H_2$, $D_0$), polygon (B) with coordinates ($H_2$, $D_1$), ($H_2$, $D_2$), ($H_3$, $D_2$), and ($H_3$, $D_1$), and polygon (C) with coordinates ($H_3$, $D_1$), ($H_3$, $D_2$), ($H_4$, $D_2$), and ($H_4$, $D_1$), wherein $D_1$ is 0.5 inches or more from $D_0$, $D_2$ is 1.8 inches or less from $D_0$, $H_4$ is 0.2 inches or less above $H_3$, $H_3$ is even with, or below, the raised lip portion, $H_2$ is 0.2 inches or more below $H_3$, and $H_1$ is 0.5 inches or less below $H_0$.

38. A drink-through lid as set forth in claim 37, wherein $H_2$ is 0.3 inches or more below $H_3$.

39. A drink-through lid as set forth in claim 37, wherein $H_2$ is 0.4 inches or more below $H_3$.

40. A drink-through lid as set forth in claim 37, wherein at least some of the stacked polygons comprise rectangles.

41. A drink-through lid as set forth in claim 37, wherein the drink outlet defined by outer slit has a maximum height $O_{max}$ above height $H_0$ and wherein $O_{max}$ is at least a distance of $H_2$, or greater, below the height $H_3$.

42. A drink-through lid as set forth in claim 41, wherein $H_2$ is 0.4 inches or more below $H_3$.

43. A drink-through lid as set forth in claim 37, wherein $D_2$ is 1.6 inches or less from $D_0$.

44. A drink-through lid as set forth in claim 37, wherein $D_2$ is 1.4 inches or less from $D_0$.

* * * * *